United States Patent [19]

Clegg

[11] Patent Number: 4,691,546

[45] Date of Patent: Sep. 8, 1987

[54] ROLLING MILL CONTROL FOR TANDEM ROLLING

[75] Inventor: Roy Clegg, Rotherham, England

[73] Assignee: Davy McKee (Sheffield) Limited, Sheffield, England

[21] Appl. No.: 549,744

[22] Filed: Nov. 8, 1983

[30] Foreign Application Priority Data

Nov. 11, 1982 [GB] United Kingdom ..... 8232188

[51] Int. Cl.[4] ..... B21B 37/12

[52] U.S. Cl. ..... 72/9; 72/12; 72/16; 72/17; 72/234

[58] Field of Search ..... 72/8, 9, 11, 12, 16, 72/17, 205, 20, 21, 234, 226

[56] References Cited

U.S. PATENT DOCUMENTS 3,169,424 2/1965 Branscom et al. ..... 72/234 X
3,782,153 1/1974 Winchester ..... 72/9
3,808,858 5/1974 Connors et al. ..... 72/16 X
3,881,335 5/1975 Cook ..... 72/11
3,892,112 7/1975 Smith, Jr. ..... 72/11
4,030,326 6/1977 Morooka et al. ..... 72/8

FOREIGN PATENT DOCUMENTS 1224713 3/1971 United Kingdom .

*Primary Examiner*—Francis S. Husar
*Assistant Examiner*—Steve Katz
*Attorney, Agent, or Firm*—Schwartz & Weinrieb

[57] ABSTRACT

In a method of operating a tandem rolling mill, the speeds of the mill rolls are kept constant, a signal representing the mass flow of material entering the first stand is compared with a signal representing the desired mass flow of material leaving the last mill stand and the difference, if any, is used to control the load on the first stand in the sense to reduce the difference substantially to zero.

5 Claims, 1 Drawing Figure

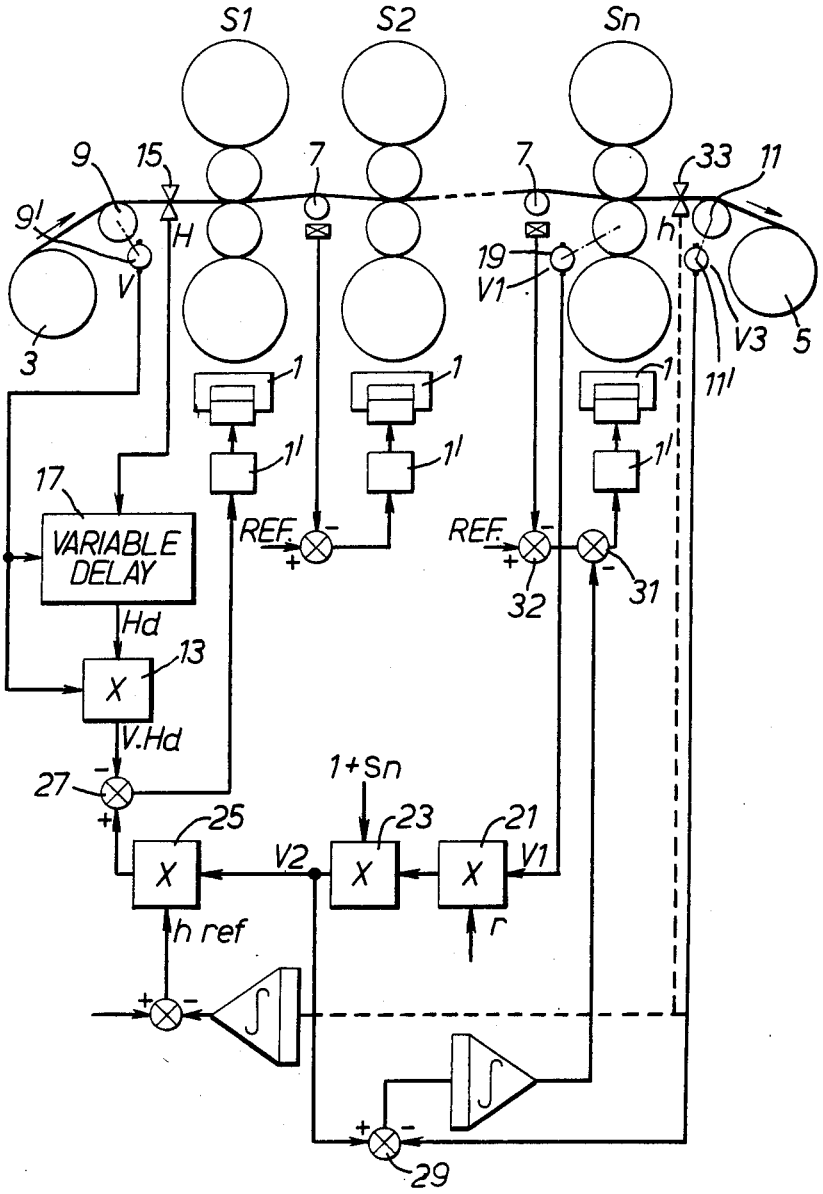
S1
S2
Sn
9
15
7
7
33
11
9'
H
h
19
V1
V
V3
5
3
11'
1
1
1
1'
1'
1'
17
VARIABLE DELAY
REF.
REF.
32
31
Hd
13
X
V.Hd
27
1+Sn
25
23
21
V2
V1
X
X
X
h ref
r
29

ROLLING MILL CONTROL FOR TANDEM ROLLING

FIELD OF THE INVENTION

This invention relates to a method of operating a plurality of rolling mill stands arranged in tandem in order to control the gauge of a workpiece as it leaves the last stand.

BACKGROUND OF THE INVENTION

It is well known to roll a metal workpiece into strip by passing it through an arrangement of a plurality of rolling mill stands arranged in tandem. Various schemes have been proposed for operating such an arrangement in order to produce strip of the required gauge at the exit of the last stand. Most of these schemes have utilised speed control on the rolls of one or more of the stands, but this is a disadvantage because, not only is the speed control equipment necessarily expensive to provide, but the drives have a relatively low speed response.

OBJECT OF THE INVENTION

It is now becoming well known for rolling mill stands to be provided with hydraulic capsules in the mill housings in order to adjust the roll gap and, hence, the load on the workpiece as it is being rolled. Many stands now have these hydraulic capsules as original equipment and many more have been rebuilt to incorporate the capsules. One of the most important advantages of hydraulic capsules is their rapid response and it is an object of the present invention to utilise this advantage to at least one stand of a plurality of rolling mill stands arranged in tandem in order to control the gauge of the workpiece as it leaves the last stand.

SUMMARY OF THE INVENTION

According to the present invention, in a method of operating a plurality of rolling mill stands arranged in tandem, and where at least the first stand is provided with hydraulic means for controlling the rolling load on the stand, a signal, representing the product of the velocity and gauge of the workpiece entering the first stand of the mill, is compared with a signal, representing the product of the desired exit speed and the desired exit gauge of the workpiece leaving the last stand of the mill, and the difference, if any, is employed to adjust the hydraulic means on the first stand in the sense to reduce the difference substantially to zero.

Since the signal representing the product of the desired exit speed and the desired exit gauge of the workpiece leaving the last stand is effectively a constant, the load on the first stand is adjusted so that the product of the velocity and gauge of the workpiece entering the first stand is kept constant. Thus, if the gauge of the workpiece entering the first stand increases for any reason, the first stand will be loaded by its hydraulic means to increase the reduction which takes place in the first stand and also to correspondingly reduce the speed of the workpiece as it enters the first stand.

The rolling load on the last stand can be controlled to maintain the forward slip of the stand constant by adjustment of the strip tension between the two final stands. This adjustment can be independent of, or additional to, the control of the first stand.

BRIEF DESCRIPTION OF THE DRAWINGS

In order that the invention may be more readily understood, it will now be described, by way of example only, with reference to the accompanying drawing, wherein:

The sole FIGURE is a diagram of the control circuit of a strip rolling mill having a plurality of mill stands arranged in tandem.

DETAILED DESCRIPTION OF THE PREFERRED EMBODIMENT

A rolling mill for rolling metal strip has a plurality of rolling mill stands $S_1, S_2 \ldots S_n$ arranged in tandem. The rolls of each stand are rotated at an appropriate constant speed by drive means (not shown). Each stand has a pair of hydraulic capsules 1 located between the stand housings and the bearing chock assemblies of the bottom roll. The capsules on each stand have a control device 1' by which hydraulic fluid supplied to the capsule is controlled to thereby adjust the rolling load. A coil of metal strip to be rolled is placed on an uncoiler 3 and the rolled strip is coiled on a coiler 5. Between each pair of adjacent mill stands there is a tensiometer 7. The strip going into the first stand passes over a roller 9 connected to a tachogenerator 9', and the strip leaving the last stand passes over a roller 11 connected to a tachogenerator 11'.

A signal V from the tachogenerator 9', representing the speed of the strip entering the stand $S_1$, is supplied to one input of a multiplier 13. A signal from a gauge 15 positioned upstream of stand $S_1$ represents the thickness H of the strip at the gauge 15. The signal is passed to a variable delay circuit 17 and is delayed by an amount equal to the time taken by the strip to move from the gauge to $S_1$. The output $H_d$ from the delay circuit 17 is supplied to another input of multiplier 13. The output of the multiplier represents the entry mass flow $V \cdot H_d$.

A tachogenerator 19 is coupled to one of the work rolls of the last stand $S_n$ and produces a signal $V_1$ which represents the angular velocity w of the roll. In a multiplier circuit 21, the signal $V_1$ is modified by a constant, representing the radius of the roll, to produce a signal proportional to wr. The exit speed of strip from a pair of rolls, in which the thickness of the strip is reduced, is slightly greater than the peripheral speed of the rolls. The difference between these speeds, expressed as a fraction of the exit speed, is referred to as the forward slip(s). A constant, representing $(1+S_n)$, where $S_n$ is the estimated forward slip at the work rolls of stand $S_n$, is multiplied in a multiplier 23 with the signal proportional to wr to produce a signal $V_2$, which represents the desired exit speed of the strip from the last stand $S_n$. In a further multiplier 25, signal $V_2$ is multiplied by a signal $h_{ref}$ representing the desired exit gauge from stand $S_n$. Thus, in a comparator 27, a signal representing the mass flow $V.H_d$ of the ingoing strip is compared with the desired mass, flow $V_2h_{ref}$ of the outgoing strip. The difference signal, if any, is supplied to the controller 1' for controlling the hydraulic capsule of the mill stand $S_1$ in the sense to reduce the difference signal substantially to zero. By adjusting the load on the first stand, the speed of the strip material entering the stand is altered and so the entry mass flow is altered in the sense to make it equal to the desired mass flow of the outgoing strip.

The rolling load on each of the stands, other than the first, is adjusted in order to keep the interstand tensions constant. When a stand has its rolling load adjusted hydraulically, a signal from the tensiometer 7 immediately upstream is compared in a comparator with a reference signal and the difference signal is used to control the hydraulic capsule 1 of the stand.

The rolling load on the last stand is adjusted to maintain the forward slip of the last stand constant and equal to the estimated value by adjusting the strip tension between the last two stands. The principle of maintaining interstand tension constant by adjustment of the rolling load of the following stand is well known. It is also known that changes in interstand tension affect the forward slip at the following stand. It is, therefore, possible to adjust the interstand tension to maintain the, forward slip constant at the next stand.

As mentioned above, the forward slip at the last stand is estimated and is used to predict the exit strip speed $V_2$. Furthermore, a signal $V_3$ from the tachogenerator 11', and representing the actual speed of the strip leaving the last stand, is compared in a comparator 29 with the predicted strip speed $V_2$. The error signal, if any, is integrated in integrator-amplifier S and fed as one input to a comparator 31. In a comparator 32, a reference signal for the interstand tension between the last two stands is compared with a signal of the tension from tensiometer 7 between the stands and the difference serves as a second input signal to the comparator 31. The output from comparator 31 is applied to the hydraulic capsule control 1' on the last stand. Thus, the difference between the actual exit speed of the strip and the predicted exit speed is used to adjust the load on the last stand, to adjust the interstand tension and, hence, the forward slip of the last stand is maintained at the estimated value so that the actual speed is made equal to the desired exit speed.

A gauge 33 measures the gauge of the strip leaving the last stand and its output is employed to trim the input signal $h_{ref}$ to the multiplier circuit 25 if the actual exit gauge is different from the desired exit gauge.

The operation of the rolling mill stands is based on the following theory:

If $$V \cdot H_d = V_2 h_{ref}$$

and $$V_3 = V_2 \text{ (By closed loop control of the forward slip of the last stand)}$$

then, $$V \cdot H_d = V_3 h_{ref}$$

but, since the strip tension between the stands remains constant and positive, then, $$V \cdot H_d = V_3 h$$

then, $$V_3 h_{ref} = V_3 h$$

therefore, $$h = h_{ref}$$

where,

V is entry strip speed $V_2$ is desired exit strip speed $V_3$ is actual exit strip speed $H_d$ is entry gauge at stand $S_1$ $h_{ref}$ is desired exit gauge h is actual exit gauge.

The advantages to be derived from such a scheme are as follows:

(a) the stiffness of the stands can be reduced thereby significantly reducing eccentricity imprint. This is especially important in the case of stand $S_1$ since the high response entry mass flow arrangement effectively compensates for errors due to entry gauge variations and material hardness variations, which would otherwise be seen as gauge variations on the exit side of stand $S_1$, and (b) high dynamic response of the drives is not required since the stand speeds are not adjusted to effect the gauge control.

Although, in the arrangement shown, all the stands are provided with a hydraulic capsule, the invention can be applied to an arrangement where only the first stand is supplied with a hydraulic capsule and the other stands are provided with mechanical screwdowns for adjusting the rolling load.

Obviously, many modifications and variations of the present invention are possible in light of the above teachings. It is therefore to be understood that within the scope of the appended claims, the present invention may be practiced otherwise than as specifically described herein.

I claim:

1. A method of operating a rolling mill to roll metal strip wherein said mill has a plurality of rolling mill stands arranged in tandem, and wherein further, the first and last stands of said mill are provided with hydraulic means for controlling the rolling load upon said stands, said method comprising the steps of:

obtaining a first signal representing the product of the velocity and gauge of said metal strip entering said first stand;

obtaining a second signal representing the product of the desired exit speed and the desired exit gauge of said metal strip leaving said last stand of said mill;

obtaining a third signal representing the actual exit speed of said metal strip leaving said last stand of said mill;

comparing said first and second signals and employing the difference, if any, between said first and second signals to adjust said hydraulic means upon said first stand in the sense so as to reduce said difference substantially to zero whereby the entry mass flow of said metal strip will equal the desired exit mass flow of said metal strip; and comparing said third signal with a fourth signal representing said desired exit speed of said metal strip leaving said last stand and employing the difference, if any, between said third and fourth signals to control the load upon said last stand in the sense so as to reduce said difference substantially to zero whereby said actual exit speed is maintained substantially equal to said desired exit speed and, in turn, the actual exit mass flow of said metal strip is substantially equal to said entry and desired exit mass flows of said metal strip.

2. A method of operating a rolling mill as claimed in claim 1, where the first signal is obtained by multiplying together a signal obtained from speed measuring means positioned upstream of the first stand and a signal from a gauge positioned upstream of the first stand, the signal from the gauge being delayed by a time equivalent to the time taken for the strip to move from the gauge to the first stand.

3. A method of operating a rolling mill as claimed in claim 1, wherein the second signal is obtained from a signal representative of the actual angular speed of rotation of the rolls of the last stand and a signal representative of the estimated forward slip of the last stand.

4. A method as set forth in claim 2, wherein:

said speed measuring means is a tachogenerator.

5. A method as set forth in claim 3, wherein:

said actual angular speed of rotation of said rolls of said last stand is derived from a tachogenerator.

* * * * *